US005579676A

United States Patent [19]

Wilke

[11] Patent Number: 5,579,676

[45] Date of Patent: Dec. 3, 1996

[54] HYDRAULIC VALVE TO MAINTAIN CONTROL IN FLUID-LOSS CONDITION

[75] Inventor: Raud A. Wilke, Dousman, Wis.

[73] Assignee: HUSCO International, Inc., Waukesha, Wis.

[21] Appl. No.: 502,026

[22] Filed: Jul. 13, 1995

[51] Int. Cl.[6] ..... F15B 11/08; F15B 13/04

[52] U.S. Cl. ..... 91/420; 91/421; 91/436; 91/446; 137/106

[58] Field of Search ..... 91/420, 421, 436, 91/517, 444, 445, 446, 447, 448; 137/106

[56] References Cited

U.S. PATENT DOCUMENTS

| | | | |
|---|---|---|---|
| 3,685,540 | 8/1972 | Wilke | 137/596.13 |
| 4,446,890 | 5/1984 | Simpson, Jr. | 91/421 X |
| 5,036,750 | 8/1991 | Katayama | 91/445 X |
| 5,076,143 | 12/1991 | Ogawa | 91/420 |
| 5,113,894 | 5/1992 | Yoshida | 137/106 |
| 5,347,811 | 9/1994 | Hasegawa et al. | 91/517 X |
| 5,400,816 | 3/1995 | Gerstenberger | 91/447 X |

*Primary Examiner*—Hoang Nguyen
*Attorney, Agent, or Firm*—Quarles & Brady

[57] ABSTRACT

A hydraulic fluid-loss control valve for preventing uncontrolled load movement in the event of a fluid loss such as from the bursting of a hose and further for allowing an operator to move the load in a controlled way despite the fluid loss. The control valve is situated between a conventional main spool valve and a piston/cylinder hydraulic actuator which powers the load. The control valve has a spool sliding reciprocally in a bore. Grooves and lands on the spool combine with passages in the control valve body to provide alternate fluid paths between a pump and the actuator and between the actuator and a reservoir. Fluid can flow from a controlled chamber of the actuator only when the spool is in a position which provides a fluid path. A passage within the spool provides fluid communication between an input fluid flow and a chamber at one end of the spool. A second passage within the spool provides fluid communication between an actuator chamber and a chamber at the other end of the spool. The position of the spool is determined by the balancing of the opposing end-chamber pressures, which is under the control of the operator.

9 Claims, 2 Drawing Sheets

HYDRAULIC VALVE TO MAINTAIN CONTROL IN FLUID-LOSS CONDITION

The invention relates to hydraulic valves which allow an operator to maintain control over a load despite a downstream fluid loss such as occurs, for example, when a hose breaks.

BACKGROUND

Many machines drive one or more loads by hydraulic force. Common examples of such machines include earth handling machines such as front end loaders, backhoes and the like. In such machines, a load, such as a scoop or shovel, is supported vertically (or controlled while moving in another direction) by the force exerted by confined hydraulic fluid. The uncontrolled escape of such fluid, as when a hose bursts, would allow the load to drop (or move uncontrolled in the other direction) absent protective measures.

Many of the previously known protective measures employ a check valve located at the hydraulic actuator, such as a piston in a cylinder, which is powering the load. The check valve prevents the escape of the fluid from the cylinder in the event a hose breaks downstream from the cylinder. This prevents the load from moving uncontrollably but leaves it hung up and beyond further control by the operator.

There is a need for a relatively simple and economical means both to prevent uncontrolled movement by a load in the event of such a fluid loss and to allow the load to be moved under the control of the operator.

SUMMARY

The present invention is directed toward satisfying that need.

The invention provides a hydraulic fluid-loss control device. It receives hydraulic fluid from a source at a flow rate controlled by an operator and feeds it to a powered chamber of a load-powering actuator. It also receives hydraulic fluid from an evacuating chamber of the actuator and disperses it from the device. The device has a body having a spool passage, a first fluid passage adapted to receive fluid from the source, a second fluid passage adapted to disperse evacuating-chamber fluid from the device, a third fluid passage adapted to disperse source fluid to the powered chamber and a fourth fluid passage adapted to receive fluid from the evacuating chamber. The four fluid passages intersect the spool passage. There is a spool adapted to slide in the spool passage in a first direction and in an opposite second direction between a neutral position and a plurality of load-powering positions. The spool has axially spaced-apart first and second ends and axially spaced apart first and second radial grooves. The grooves are arranged so that the first groove always extends into the first fluid passage, and also extends into the third fluid passage when the spool is in one of the load-powering positions but not when it is in the neutral position. The grooves are further arranged so that the second groove always extends into the fourth fluid passage, and also extends into the second fluid passage when the spool is in one of the load-powering positions but not when it is in the neutral position. There is a first pilot chamber disposed so that pressure in the first pilot chamber urges the spool toward the neutral position. The first pilot chamber is also disposed to be in fluid communication with the third fluid passage. There is also a second pilot chamber disposed so that pressure in the second pilot chamber urges the spool toward one of the load-powering positions. The second pilot chamber is also disposed to be in fluid communication with the first fluid passage. As a result, fluid from the evacuating chamber is dispersed from the device only when the spool is in one of the load-powering positions, the position of the spool being determined by the operator's control of the flow rate of the fluid from the source into the device.

In another aspect of the invention, the spool has within it at least either a first pilot passage which provides fluid communication between the third fluid passage and the first pilot chamber or a second pilot passage which provides fluid communication between the first fluid passage and the second pilot chamber.

In yet another aspect, at least one of the first and second pilot chambers is adjacent to and in fluid communication with one of the ends of the spool.

The invention thus prevents uncontrolled movement by a load in the event of a fluid loss and allows the operator to maintain control and move the load under the operator's control.

These and other features, aspects and advantages of the present invention will become better understood with reference to the following description and drawings of a preferred embodiment of the invention. The invention is, however, not limited to that embodiment.

DETAILED DESCRIPTION OF A PREFERRED EMBODIMENT

Figure 1:
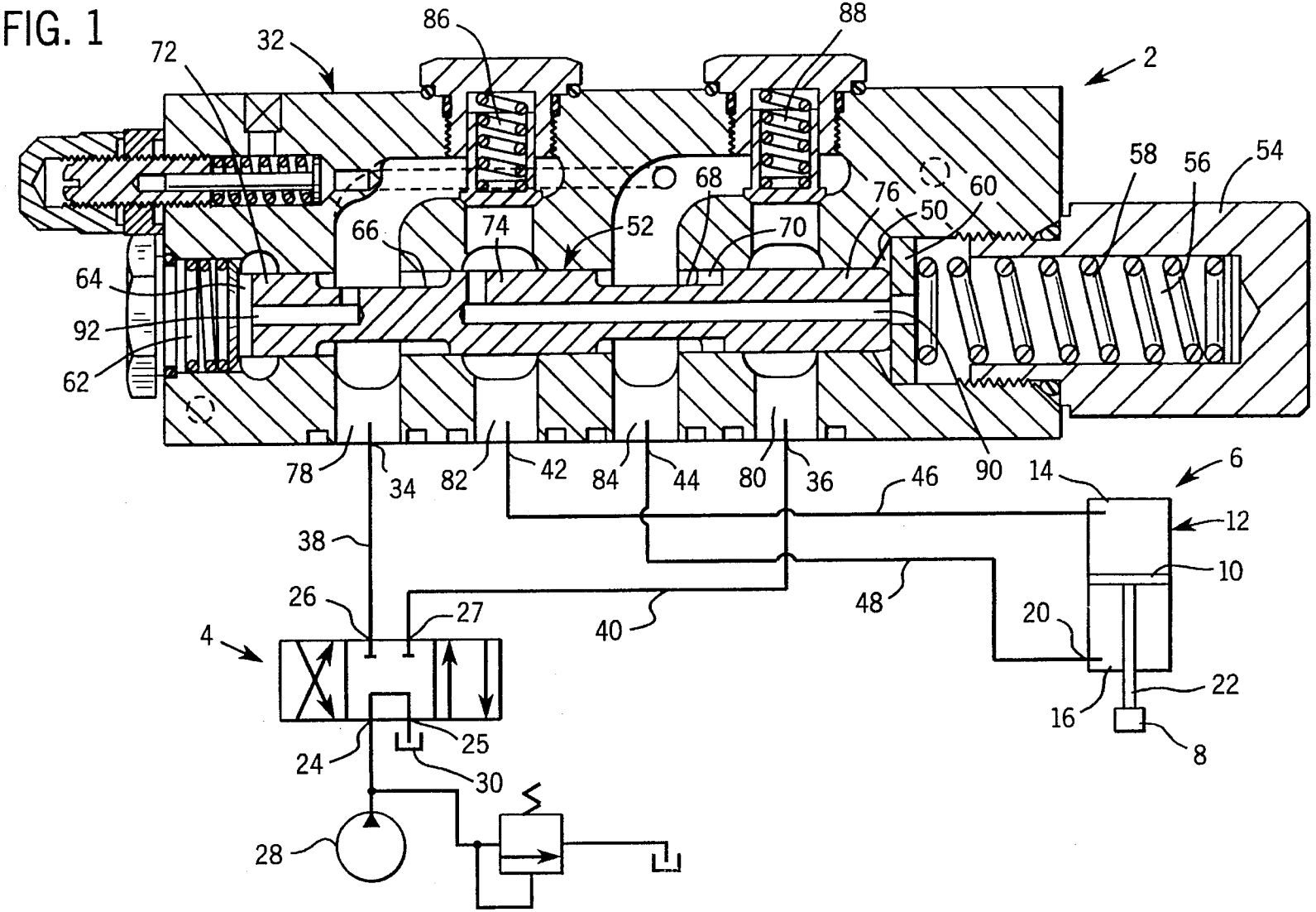
FIG. 1 illustrates a cross-sectional view of an embodiment of the claimed fluid-loss control valve in a neutral mode and schematically shows components with which it may be used.
Figure 2:
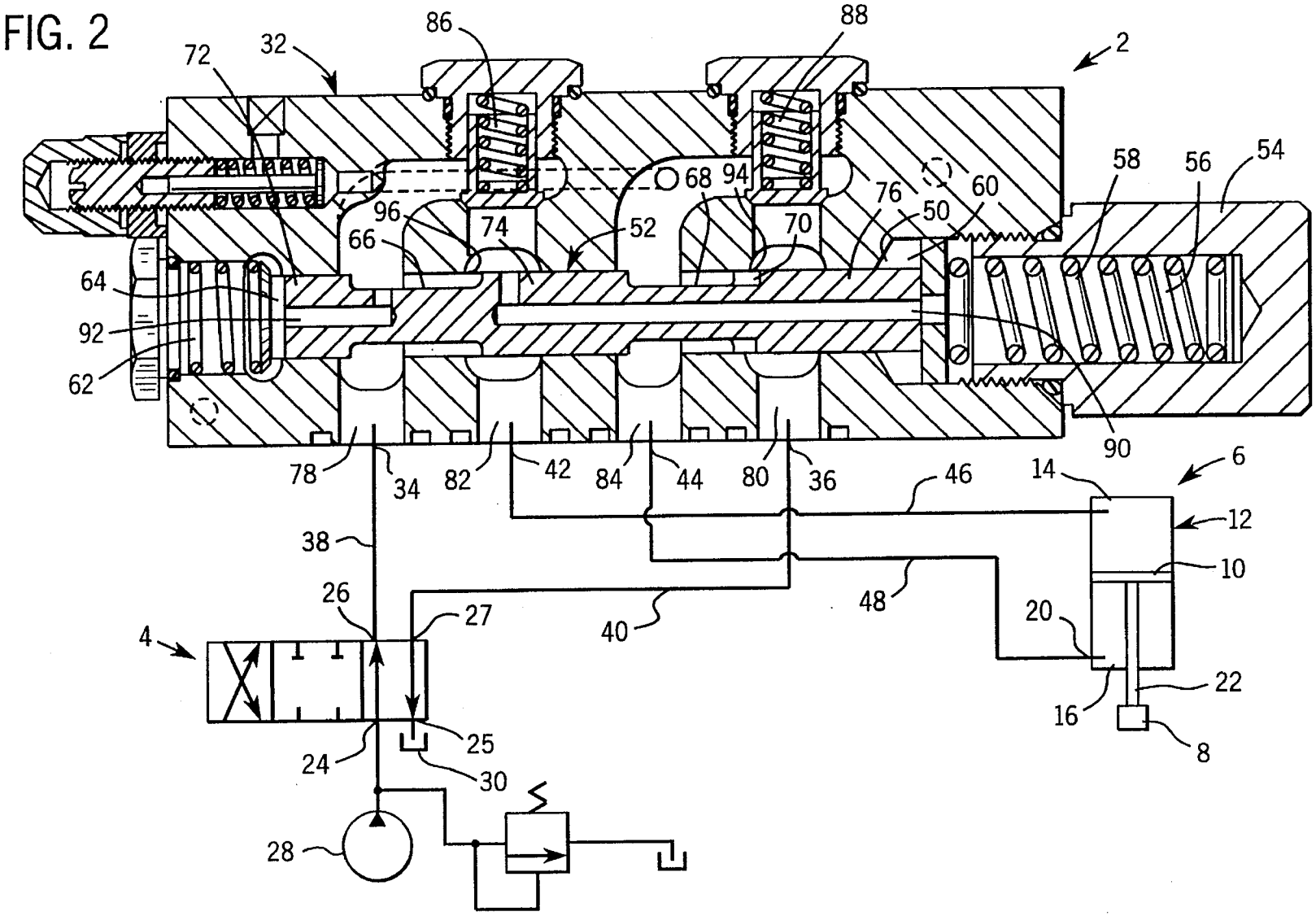
FIG. 2 is the same as FIG. 1 except that the valve is in a load-raising mode.

FIGS. 1 and 2 illustrate a fluid-loss control valve 2 in a hydraulic circuit between an operator-controlled main valve 4 (shown schematically) and an hydraulic actuator 6 (also shown schematically) which moves a load 8 up and down. (As used herein, directional terms are derived from the orientation shown in FIGS. 1 and 2 but include other corresponding directions in embodiments deployed in other orientations).

The hydraulic actuator 6 shown is of the type in which a piston 10 divides a cylinder 12 into two variable-volume chambers (top 14 and bottom 16), each of which has a port (top-chamber port 18 and bottom-chamber port 20) which allows inflow and outflow of hydraulic fluid. The load 8 is attached to a rod 22 affixed to the piston 10.

The main valve 4 has first 24 and second 25 downstream ports which are connected to a pump 28 and a reservoir 30 respectively, and first 26 and second upstream 27 ports. In FIG. 1 the main valve 4 is shown schematically in a central neutral position which connects pump port 28 to the reservoir 30. FIG. 2 shows the main valve 4 in a "load-lowering" position which connects the first and second upstream ports 26, 27 to the pump 28 and the reservoir 30 respectively. In a "load-raising" position (not shown), the main valve 4 connects the first and second upstream ports 26, 27 to the reservoir 30 and the pump 28 respectively. An operator can control the rate of flow of fluid from the pump 28 through the main valve 4 to the fluid-loss control valve 2.

The fluid-loss control valve 2 comprises a body 32 having bores and passages described below.

The body 32 has first 34 and second 36 control valve ports which are connected to the first and second upstream ports 26, 27 of the main valve 4 by lines 38 and 40, which are typically hoses or similar conduits inasmuch as the fluid control valve 2 is located remotely from the main valve 4. The fluid loss control valve 2 also has third 42 and fourth 44 control-valve ports which are connected to the top-chamber port 18 and the bottom-chamber port 20 of the cylinder 12 respectively by lines 46 and 48, which are typically direct connectors since the fluid loss control valve 2 is typically located on or at the hydraulic actuator 6.

The body 32 of the fluid-loss control valve 2 has a longitudinal spool bore 50 in which a spool 52 slides longitudinally. The right end of the spool bore 50 is widened and is closed by a hollowed right-side plug 54, the hollow of which defines a first pilot chamber 56 which contains a spring 58 which abuts a spring retainer 60 on the right end of the spool 52 and urges the spool 52 leftward. The left end of the spool bore 50 is closed by a closed left-side plug 62, against which the left end of the spool 52 normally abuts under the urging of the spring 58. The left end of the spool 52 is hollowed to define, with the left-side plug 62 and the body 32, a second pilot chamber 64. The spool 52 is radially indented by the axially-spaced first 66 and second 68 grooves. The right end of the second groove 68 is a shallower metering notch 70. The unindented portions of the spool 52 are the first, second and third lands 72, 74, 76, which are axially separated by the two grooves 66, 68.

Extending into the body 32 of the fluid-loss control valve 2 from the first, second, third and fourth control-valve ports 34, 36, 42, 44 are four fluid passages (the first 78, second 80, third 82 and fourth 84 respectively) which intersect the spool bore 50 and extend inwardly beyond it. The inward ends of the first 78 and third 82 fluid passages are connected to a normally closed first check valve 86 which, when open, permits fluid communication between the third and first control-valve ports 42, 34 (the "top-chamber check-valve fluid path"). Similarly, the inward ends of the second 80 and fourth 84 fluid passages are connected to a normally closed second check valve 88 which, when open, permits fluid communication between the second and fourth control-valve ports 36, 44 (the "bottom-chamber check-valve fluid path").

The four fluid passages 78, 80, 82, 84 are located in the body 32 so that, when the spool 52 is its leftward neutral position (FIG. 1), the first 78 and fourth 84 fluid passages are open only to the first and second spool grooves 66, 68 respectively and the second 80 and third 82 fluid passages are open only to the third 76 and second 74 spool lands respectively. The grooves 66, 68 and lands 72, 74, 76 are sized so that when the spool 52 moves at least a minimum distance to the right (FIG. 2), the first groove 66 extends into both the first 78 and the third 82 fluid passages and establishes fluid communication between them (the "top-chamber groove fluid path"), and the metering notch 70 of the second groove 68 extends into both the second 80 and the fourth 84 fluid passages and establishes fluid communication between them (the "bottom-chamber groove fluid path").

The spool 52 is bored to provide two pilot passages 90, 92 within it. The first pilot passage 90 is open to the first pilot chamber 56 and extends leftward from the right end of the spool 2 below the third land 76 and second groove 68 and emerges laterally from the spool 52 in the second land 74 (and thus opens to the third fluid passage 82). The second pilot passage 92 extends rightward from the second pilot chamber 64 below the first land 72 and emerges laterally from the spool 52 in the first groove 66 (and thus opens to the first fluid passage 78).

When the system is in neutral as illustrated in FIG. 1, fluid under the pressure of the top chamber 14 of the actuator cylinder 12 occupies the third fluid passage 82, the first pilot passage 90 and the first pilot chamber 56. The pressure force and the spring 58 in the first pilot chamber 56 hold the control-valve spool 52 leftward so that the second pilot chamber 64 abuts the closed left-side plug 62.

When the operator initiates a load-lowering action, the main-valve shifts to the position shown in FIG. 2 and thereby connects the pump 28 to the first control valve port 34 and connects the reservoir 30 to the second control valve port 36. When that happens, fluid from the pump 28 occupies the first fluid passage 78 (blocked by the first check valve 86), the second pilot passage 92 and the second pilot chamber 64. When the force exerted by the increasing pressure in the second pilot chamber 64 exceeds the opposing force of the spring 58 and the top-chamber pressure in the first pilot chamber 56, the control valve spool 52 begins to move to the right. As this movement continues, the first groove 66 begins to extend into the third fluid passage 82, as illustrated in FIG. 2. This allows fluid to flow from the pump 28 to the top chamber 14 of the actuator 6 through the first control-valve port 34, the top-chamber groove fluid path (described above) and the third control-valve port 42. At approximately the same time, the metering notch 70 of the second groove 68 begins to extend into the second fluid passage 80, as illustrated in FIG. 2. This allows fluid to flow from the bottom chamber 16 of the actuator cylinder 12 to reservoir 30 through the fourth control-valve port 44, the bottom-chamber groove fluid path (described above) and the second control-valve port 36. As a result, the actuator piston 10, and hence the load 8, moves downward.

In this load-lowering mode, the rate of flow, if any, of fluid from the bottom chamber 16 of the actuator 6 is determined by the position of the spool 52, as follows. The portion of the metering notch 70 which extends into the second fluid passage 80 forms a first groove orifice 94. The larger the first groove orifice 94, the greater the fluid flow from the bottom chamber 16 to the reservoir 30. If the metering notch 70 does not extend into the second fluid passage 80, there is no groove orifice 94, and there is no fluid flow.

The position of the spool 52 (and hence the rate of fluid flow from the bottom chamber 16 to the reservoir 30) is determined by a balance achieved between the rightward force on the spool 52 induced by the pressure in the second pilot chamber 64 and the leftward force induced by the spring 58 and the pressure in the first pilot chamber 56. The pressure in the second pilot chamber 64 is determined by the pump output fluid flow (which is in the control of the operator), and the pressure in the first pilot chamber 56 is the top-chamber pressure. The difference between these pressures is seen as a pressure drop across a second groove orifice 96 (which is the extent to which the first groove 66 extends into the third fluid passage 82). An increase in the pump output fluid flow increases this pressure drop and thereby increases the rate of flow through the second groove orifice 96 to the top chamber 14. This increases the top-chamber pressure, which increases the pressure in the first pilot chamber 56 and therefore tends to move the spool 52 leftward and reduce the second groove orifice 96. If, however, the actuator piston 10 moves down, the pressure in the actuator top chamber 14 and in the first pilot chamber 56 is reduced, tending to allow the spool 52 to move rightward and thereby increase the second groove orifice 96. An equilibrium position is achieved at which the spool 52 is allowing the rate of fluid flow from the pump 28 to the actuator top chamber 14 that the operator desires.

Whether, and the rate at which, the piston 10 can move down is determined by the extent to which the first groove orifice 94 is open. This is determined by the position of the spool 52 which, as described above, is ultimately controlled by the operator's manipulation of the pump output fluid flow. It is this characteristic which provides continued control in the event of a loss of fluid in the line 40 between the second control valve port 36 and the main valve 4.

The fluid loss control valve 2 is typically affixed to the actuator 6, while the main valve 4 is located at a distance, e.g., in the cab of the machine. They are connected by hoses (represented by lines 38 and 40 in the Figures). In the absence of the present invention (or some other protective structure), the bursting of line 40 would cause the load 8 to drop uncontrollably. With the present invention, the loss of fluid in line 40 does not drain fluid from the actuator bottom chamber 16. Rather, fluid is drained from the bottom chamber 16 only to the extent that the bottom-chamber groove fluid path is open through the first groove orifice 94. As described above, this is entirely under the control of the operator. In fact, the operator can, by manipulating the first groove orifice 94, gently lower the load 8 to the ground notwithstanding the bursting of the line 40. This is a definite advantage over known devices, including that described in U.S. Pat. No. 3,685,540 (see col. 7, lines 49–57), which rely on check valves to prevent load drop and therefore hold the load 8 in a raised position in the event of a hose failure.

To raise the load 8, the operator moves the main valve 4 to the load-raising position (not shown) in which the pump 28 is connected to the second upstream port of the main valve 4 and thence to the second control valve port 36 and the second fluid passage 80 of the control valve 2. The second check valve 88 opens, allowing pump fluid to flow through the bottom chamber check-valve fluid path (described above) to the bottom chamber 16 of the actuator 6. In the load-raising position, the main valve 4 also connects the reservoir 30 to the first upstream port of the main valve 4 and thus to the first control valve port 34. Increasing pressure in the top chamber 14 of the actuator 6 opens the first check valve 86, allowing fluid to flow from the top chamber 14 through the top-chamber check valve fluid path (described above) to the reservoir 30. In this mode, the spool 52 of the fluid-loss control valve 2 is in its leftward position (as in FIG. 1) because the second pilot chamber 64 is open to the reservoir 30 and therefore exerts no rightward force. If line 40 should break in the load-raising mode, fluid would not flow out of the actuator bottom chamber 16 because the second check valve 88 would close (thereby closing the bottom-chamber check-valve fluid path) and the metering notch 70 would not extend into the second fluid passage 80 (thereby closing the bottom-chamber groove path).

The foregoing description of a preferred embodiment of the invention shows its advantages. In the event of a leak or rupture in a fluid line 40 between the main valve 4 and the hydraulic actuator 6, the invention prevents the load 8 from dropping and allows the operator to retain control over the load 8 and to gently lower it to a chosen resting place. This advantage is accomplished with a relatively simple and economical apparatus which can be attached directly to the hydraulic actuator 6.

Although the preferred embodiment of the invention has been described above, the invention claimed is not so restricted. There may be other embodiments which are within the scope of the invention claimed herein.

I claim:

1. A hydraulic fluid-loss control device for receiving hydraulic fluid from a source at a flow rate controlled by an operator and feeding the hydraulic fluid to a powered chamber of a load-powering actuator and for receiving additional hydraulic fluid from an evacuating chamber of the actuator and dispersing the additional hydraulic fluid from the device, the hydraulic fluid-loss control device comprising:

(a) a body having a spool passage, a first fluid passage adapted to receive fluid from the source, a second fluid passage adapted to disperse evacuating-chamber fluid from the device, a third fluid passage adapted to disperse source fluid to the powered chamber and a fourth fluid passage adapted to receive fluid from the evacuating chamber, the four fluid passages intersecting the spool passage;

(b) a spool adapted to slide in the spool passage in a first direction and in an opposite second direction between a neutral position and a plurality of load-powering positions, the spool having axially spaced-apart first and second ends and axially spaced apart first and second radial grooves, the grooves arranged so that the first groove always extends into the first fluid passage and also extends into the third fluid passage when the spool is in one of the load-powering positions but not when the spool is in the neutral position and so that the second groove always extends into the fourth fluid passage and also extends into the second fluid passage when the spool is in one of the load-powering positions but not when the spool is in the neutral position;

(c) a first pilot chamber disposed so that pressure in the first pilot chamber urges the spool toward the neutral position, the first pilot chamber also disposed to be in fluid communication with the third fluid passage;

(d) a second pilot chamber disposed so that pressure in the second pilot chamber urges the spool toward one of the load-powering positions, the second pilot chamber also disposed to be in fluid communication with the first fluid passage;

(e) whereby fluid from the evacuating chamber is dispersed from the device only when the spool is in one of the load-powering positions, the position of the spool being determined by the operator's control of the flow rate of the fluid from the source into the device.

2. A hydraulic fluid-loss control device as recited in claim 1, wherein the spool has within it at least either a first pilot passage which provides fluid communication between the third fluid passage and the first pilot chamber or a second pilot passage which provides fluid communication between the first fluid passage and the second pilot chamber.

3. A hydraulic fluid-loss control device as recited in claim 1, wherein at least one of the first and second pilot chambers is adjacent to and in fluid communication with one of the ends of the spool.

4. A hydraulic fluid-loss control device as recited in claim 3, wherein the spool has within it at least either a first pilot passage which provides fluid communication between the third fluid passage and the first pilot chamber or a second pilot passage which provides fluid communication between the first fluid passage and the second pilot chamber.

5. The hydraulic fluid-loss control device as recited in claim 1, wherein the spool has therein a first pilot passage which provides fluid communication between the third fluid passage and the first pilot chamber; and a second pilot passage which provides fluid communication between the first fluid passage and the second pilot chamber.

6. The hydraulic fluid-loss control device as recited in claim 1, further comprising a check valve located in said body and permitting fluid communication only from the third passage to the first passage.

7. The hydraulic fluid-loss control device as recited in claim 1, further comprising a check valve located in said body and permitting fluid communication only from the second passage to the fourth passage.

8. The hydraulic fluid-loss control device as recited in claim 1, further comprising a first check valve located in said body and permitting fluid communication only from the third passage to the first passage; and a second check valve located in said body and permitting fluid communication only from the second passage to the fourth passage.

9. A hydraulic fluid-loss control device for receiving hydraulic fluid from a source at a flow rate controlled by an operator and feeding the hydraulic fluid to a powered chamber of a load-powering actuator, and for receiving additional hydraulic fluid from an evacuating chamber of the actuator and dispersing the additional hydraulic fluid from the device, the hydraulic fluid-loss control device comprising:

(a) a body having a spool passage, a first fluid passage adapted to receive fluid from the source, a second fluid passage adapted to disperse evacuating-chamber fluid from the device, a third fluid passage adapted to disperse source fluid to the powered chamber and a fourth fluid passage adapted to receive fluid from the evacuating chamber, the four fluid passages intersecting the spool passage, and wherein the first fluid passage communicates with the third fluid passage at a first junction and the second fluid passage communicates with the fourth fluid passage at a second junction;

(b) a spool adapted to slide in the spool passage in a first direction and in an opposite second direction between a neutral position and a plurality of load-powering positions, the spool having axially spaced-apart first and second ends and axially spaced apart first and second radial grooves, the grooves arranged so that the first groove always extends into the first fluid passage and also extends into the third fluid passage when the spool is in one of the load-powering positions but not when the spool is in the neutral position and so that the second groove always extends into the fourth fluid passage and also extends into the second fluid passage when the spool is in one of the load-powering positions but not when the spool is in the neutral position, the spool having a first pilot passage therein which provides fluid communication between the third fluid passage and the first pilot chamber, and the spool having a second pilot passage therein which provides fluid communication between the first fluid passage and the second pilot chamber;

(c) a first pilot chamber disposed so that pressure in the first pilot chamber urges the spool toward the neutral position, the first pilot chamber also disposed to be in fluid communication with the third fluid passage;

(d) a second pilot chamber disposed so that pressure in the second pilot chamber urges the spool toward one of the load-powering positions, the second pilot chamber also disposed to be in fluid communication with the first fluid passage;

(e) whereby fluid from the evacuating chamber is dispersed from the device only when the spool is in one of the load-powering positions, the position of the spool being determined by the operator's control of the flow rate of the fluid from the source into the device;

(f) a first check valve located at the first junction and permitting fluid communication only from the third passage to the first passage; and (g) a second check valve located at the second junction and permitting fluid communication only from the second passage to the fourth passage.

* * * * *